US005438907A

United States Patent [19]

Reynolds et al.

[11] Patent Number: 5,438,907

[45] Date of Patent: Aug. 8, 1995

[54] BLANK FIRING ADAPTOR

[76] Inventors: George L. Reynolds, R.R. 1 Box 324, Altona, Ill. 61414; John M. Miller, Rte. #3 Box 434 Winters Dr., Marietta, Ohio 45750

[21] Appl. No.: 290,079

[22] Filed: Aug. 15, 1994

[51] Int. Cl.[6] ..... F41A 21/26

[52] U.S. Cl. ..... 89/14.5; 102/530

[58] Field of Search ..... 89/14.5, 29; 102/531, 102/530; 42/54, 55, 77

[56] References Cited

U.S. PATENT DOCUMENTS

| | | | |
|---|---|---|---|
| 353,231 | 11/1886 | Morris | 89/29 |
| 2,356,538 | 8/1944 | Schmeisser | 89/14.5 |
| 4,455,777 | 6/1984 | Callies | 42/77 |

FOREIGN PATENT DOCUMENTS

| | | | |
|---|---|---|---|
| 2379041 | 8/1978 | France | 89/14.5 |
| 279655 | 12/1951 | Switzerland | 42/77 |
| 600284 | 6/1978 | Switzerland | 42/77 |
| 726141 | 3/1955 | United Kingdom | 42/77 |
| 9114916 | 10/1991 | WIPO | 102/530 |

*Primary Examiner*—Stephen M. Johnson
*Attorney, Agent, or Firm*—Robert O. Richardson

[57] ABSTRACT

The weapon bolt is driven rearward by gas pressure from a blank cartridge with the reaction being transmitted to the weapon frame through a spigot inserted through the barrel and attached to the weapon muzzle. Power is thereby provided to perform cycling of the weapon.

6 Claims, 1 Drawing Sheet

BLANK FIRING ADAPTOR

BACKGROUND OF THE INVENTION

Current medium caliber automatic weapons such as the MK19 40 mm machinegun used by the U.S. military forces require relatively expensive training ammunition, and ranges adequate for firing these weapons. This results in the troops not receiving adequate training. Blank firing attachments for providing realistic training are well known for use with various small arms weapons, but until the present invention none have been suitable for the MK19. The present invention provides for adequate training by firing a blank cartridge which approximates the feel and noise of firing with normal ammunition. The blank cartridge is reloadable with an easily replaced propellant unit which can be applied by soldiers training in the field. Use of the blank training cartridge requires replacement of simple parts of the weapon to prevent accidental feeding of service ammunition while the blank firing attachment is installed.

SUMMARY OF PRESENT INVENTION

The blank firing attachment of the present invention operates a weapon in automatic fire mode in the normal fashion. The adaptor screws onto the gun muzzle in place of the flash suppressor. The alignment guide assembly of the MK19 is removed and replaced with a thicker guide, allowing proper positioning of the shorter blank firing adaptor cartridge and preventing the loading of live ammunition. The ogive plunger assembly is also replaced for the same reasons. It requires only a few seconds to change between blank operation and conventional operation. The required parts are relatively inexpensive to produce in quantity. The blank firing adaptor parts should be powder coated yellow or some other distinctive color to aid visual identification. The cartridge duplicates the grooves of the M922E1 dummy round for repositioning of the link for reloading. The replaceable propellant unit is made of molded plastic. The propellant is loaded through the primer opening, and the primer pressed in with a sealer. The free volume and spigot diameter are variable to obtain proper forcing without overloading the muzzle threads. A tool will be required to unscrew and replace the propellant unit retainer.

At firing, the rupture disk of the propellant unit ruptures, filling the free volume behind the spigot and pressurizing it. This drives the cartridge with the bolt rearward. When the cartridge body has moved sufficiently rearward the vent slots in the front of the cartridge body pass the spigot, venting the gas into the barrel, through the centering ring, through the muzzle cap and out of the weapon.

DESCRIPTION OF THE ILLUSTRATIVE EMBODIMENT

Figure 1:
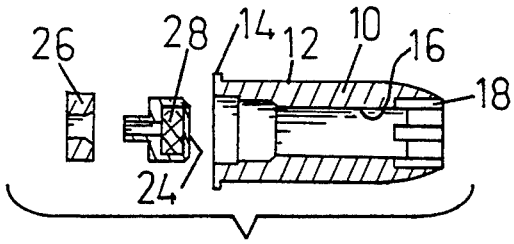
FIG. 1 is a plan view in section of the blank cartridge and the individual components of the blank cartridge.
Figure 3:
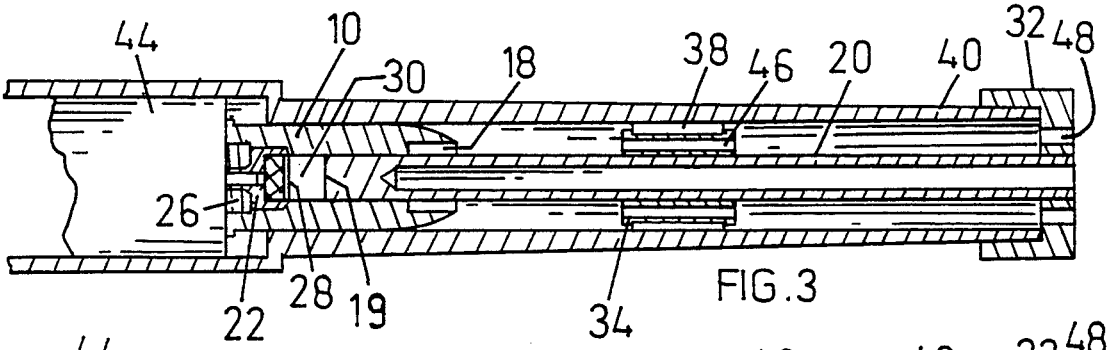
FIG. 3 is a plan view in section of the blank cartridge in the chamber of the barrel, ready to fire.
Figure 4:
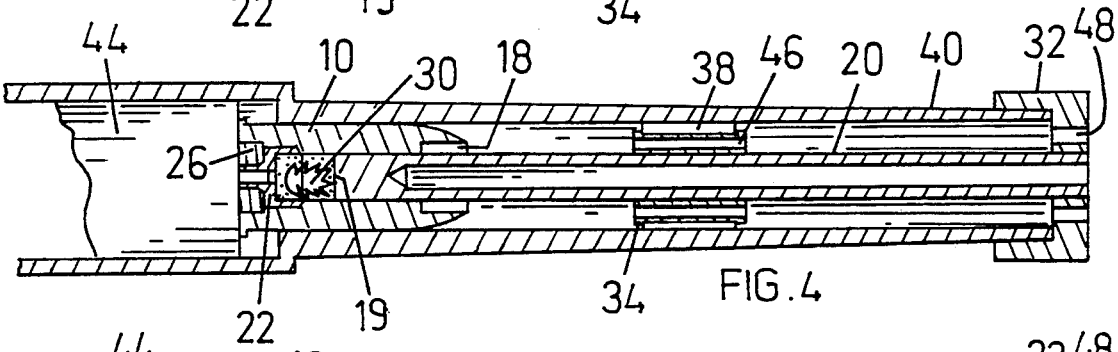
FIG. 4 is a plan view in section of the weapon and blank cartridge at the moment of firing.

Referring to FIG. 1, blank reuseable cartridge body 10 has an appropriate outer circumferance 12 to permit its insertion into a gun barrel. An enlarged rim 14 on the cartridge body 10 limits forward movement just as live cartridges are limited in forward movement. This reuseable cartridge body 10 has a central bore 16 terminating forwardly in pressure relief vents 18 as will be explained hereinafter with reference to other drawings. This central bore 16 extends over the end 19 of spigot 20 as shown in FIGS. 3 and 4. A replaceable propellant unit 22 with rupture disc 24 fits over the rear of bore 16 and is held in place by a reuseable propellant unit retainer 26. Upon detonation, the propellant 28 ruptures disc 24 and pressurizes the free volume space 30 between it and the inner end 19 of spigot 20.

Figure 2:
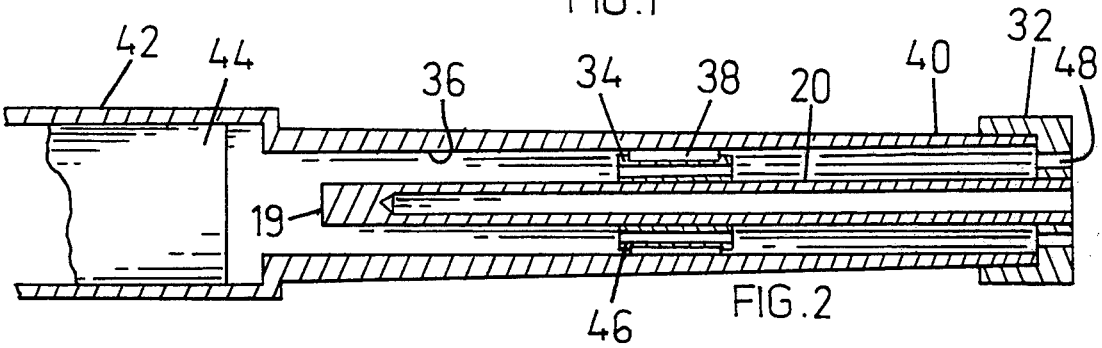
FIG. 2 is a plan view in section of the essential components of the weapon.

Referring to FIG. 2, the flash suppressor of the weapon has been replaced with the muzzle cap 32. Attached to the muzzle cap 32 is the spigot 20 with its centering ring 34. The centering ring maintains the spigot 20 in the center of the bore 36. The centering ring 34 is provided with a hard plastic sleeve 38 to protect the rifling of the barrel 40 from damage from vibration of the centering ring 34 during firing.

Referring to FIG. 3, a blank cartridge 10 has been placed in the chamber of the barrel 40. The end 19 of spigot 20 is positioned in the center of the cartridge 10, sealing the propellant unit 22 between the blank cartridge 10 and the spigot 20.

Referring to FIG. 4, a free volume or air space 30 exists between the spigot 20 and the propellant unit 22. This free volume 30 can be adjusted in the design to control the internal ballistic qualities of the propulsion system.

The propellant 28 in the propellant unit 22 has been ignited, causing gas pressure to be built up within the free volume 30. This drives the body of the blank cartridge 10 rearward. The reaction is transmitted through the spigot 20 to the muzzle cap 32 to the barrel 40 and to the frame 42. The expanding pressurized gas in the increasing free volume 30 accelerates the blank cartridge 10 and bolt 44 rearward.

Figure 5:
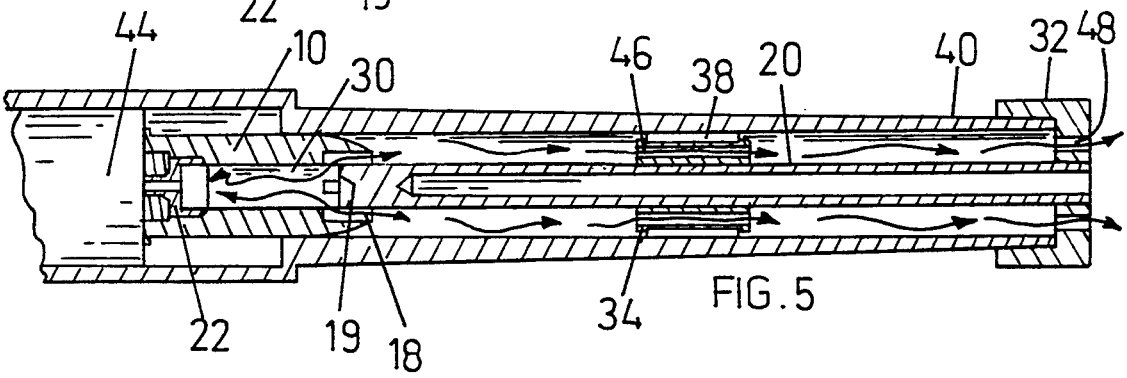
FIG. 5 is a plan view in section of the bolt in recoil.

Referring to FIG. 5, the blank cartridge 10 and bolt 44 have moved far enough rearward, as shown by the longer left pointing arrow in FIG. 5 for the pressure relief vents 18 of the blank cartridge 10 to have passed the rear 19 of the spigot 20, releasing the gas pressure into the bore 36 of barrel 40. The front of the blank cartridge 10 provides a seal to prevent the gas from escaping to the rear. The gas escapes forward through holes 46 in the centering ring 34. The gas continues forward through the bore 38 of the barrel 40 and out of the holes 48 in the muzzle cap 32. By the time the seal between the front of the blank cartridge 10 and the rear of the barrel 40 is broken, the pressure in the barrel 40 has dropped sufficiently to prevent excessive escape of gas into the breech of the weapon. The bolt 44 continues rearward to fully recoil, as shown by the longer left pointing arrow, to cycle the weapon.

Having described the preferred embodiment wherein the present invention is used, it is to be understood that variations, improvements and modifications may be made without departing from the spirit of the invention, and that such deviations and alterations are to be considered as part of the present invention as set forth in the following claims.

What I claim is:

1. A blank firing adaptor for a gun having a gun barrel and a bolt for moving cartridges into position for firing, said adaptor comprising a muzzle cap threadedly mounted on the end of said gun barrel and having a spigot attached thereto, said spigot extending centrally within said barrel, said spigot having a closed inner end;

a reuseable cartridge body insertable by said bolt of said gun into position for firing, said body having a front portion thereof insertable over said spigot inner end, said cartridge body having a propellant receiving chamber and a free volume space between said propellant receiving chamber and said spigot inner end, whereby detonation of propellant within said chamber pressurizes said free volume space and drives said cartridge body rearwardly to cycle said gun for another firing and to free said free volume space of pressure from said detonation of said propellant.

2. A blank firing adaptor as in claim 1 wherein said cartridge body has a forward portion with pressure relief vents thereon whereby pressure in said free volume space may be vented over said spigot and out of said barrel before said cartridge body is fully extracted rearwardly, 3. A blank firing adaptor as in claim 1 wherein said muzzle cap has openings therethrough to vent pressure from said barrel to atmosphere.

4. A blank firing adaptor as in claim 1 wherein a centering ring is mounted over said spigot and maintains said spigot in the center of said gun barrel.

5. A blank firing adaptor as in claim 4 wherein said centering ring has holes therein whereby pressurized gases from a cartridge propellant when detonated may pass through said holes and be vented to atmosphere.

6. A blank firing adaptor as in claim 4 wherein said centering ring is provided with a hard plastic sleeve to protect said barrel from damage from vibration of said centering ring during firing.

* * * * *